US006575605B2

(12) United States Patent
Averbeck et al.

(10) Patent No.: US 6,575,605 B2
(45) Date of Patent: Jun. 10, 2003

(54) DEVICE FOR CONNECTING THE PLUG-IN BASE OF A MAST TOP UNIT LUMINAIRE TO A CARRIER TUBE

(75) Inventors: Hartmut Averbeck, Springe (DE); Bernd-Christian Stigrot, Bad Muender (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 10/078,978

(22) Filed: Feb. 19, 2002

(65) Prior Publication Data

US 2002/0118546 A1 Aug. 29, 2002

(30) Foreign Application Priority Data

Feb. 26, 2001 (DE) ..... 101 09 255

(51) Int. Cl.[7] ..... F21S 13/10

(52) U.S. Cl. ..... 362/431; 362/226; 362/410; 362/413; 362/414; 285/309

(58) Field of Search ..... 362/431, 226, 362/410, 413, 414; 285/308, 309, 320, 22; 248/248, 188.5

(56) References Cited

U.S. PATENT DOCUMENTS 608,239 A * 8/1898 Wakefield
2,254,679 A * 9/1941 Gaskill
3,050,620 A * 8/1962 Schlosser et al.
3,410,995 A * 11/1968 Gray
4,425,610 A * 1/1984 Krubsack et al. ..... 362/419
4,639,843 A 1/1987 Compton ..... 362/431
5,016,154 A * 5/1991 Leeyeh ..... 362/414
5,060,989 A * 10/1991 Gallucci et al.
5,266,738 A * 11/1993 MacVoy ..... 174/45

* cited by examiner

*Primary Examiner*—Sandra O'Shea
*Assistant Examiner*—Jacob Y. Choi
(74) *Attorney, Agent, or Firm*—Frank Keegan

(57) ABSTRACT

The invention relates to a device for connecting the plug-in base (5) of a side-mounting luminaire to a carrier tube (3), in particular to the tube (3) of a luminaire mast, it being possible for the plug-in base (5) of the side-mounting luminaire to be connected to the carrier tube (3) and to be fixed to the carrier tube (3) by means of a securing element (15) which can be inserted into the side-mounting luminaire from the outside inward, and it being possible for the securing element (15) to be pressed against an abutment which effects clamping. The securing element (15) cooperates with a clamping device (10) which, when the securing element (15) is inserted into the tube interior (12), converts the clamping force directed away from said element into the tube interior (12) into a clamping force directed outward from the tube interior (12), the clamping device (10) pressing a clamping member (11*b*) against the inner wall (17) of the carrier tube (3), which wall acts as the abutment (16).

6 Claims, 1 Drawing Sheet

DEVICE FOR CONNECTING THE PLUG-IN BASE OF A MAST TOP UNIT LUMINAIRE TO A CARRIER TUBE

The invention relates to a device for connecting the plug-in base of a side-mounting luminaire to a carrier tube, in particular to the tube of a luminaire mast, it being possible for the plug-in base of the side-mounting luminaire to be connected to the carrier tube and to be fixed to the carrier tube by means of a securing element that can be inserted into the side-mounting luminaire from the outside inward, and it being possible for the securing element to be pressed against an abutment which effects clamping.

Such a device is disclosed in JP 10-012013A. A luminaire mast is present in whose upper open end a connecting bush is fixed. The outside diameter of the connecting bush is chosen such that this connecting bush is fixedly held in the open end of the luminaire mast and projects partly therefrom. The portion of the connecting bush projecting over the open end of the luminaire mast. A mast top unit luminaire is mounted on the portion of the connecting bush of smaller diameter projecting from the luminaire mast. For this purpose, this mast top unit luminaire has a plug-in base which fits the connecting bush. The outside diameter of the plug-in base corresponds to the outside diameter of the luminaire mast, the result being a smooth transition.

Provided on the plug-in base is a setscrew which acts as a securing element and can be screwed in from the outside inward so as to clamp the side-mounting luminaire on the luminaire mast. The setscrew can be screwed in up to an abutment which is formed by the outer wall of the connecting bush. It is known from experience that such clamps are not very stable if the material of the tube is selected to be as thin as possible for reasons of economy. A further disadvantage is that there is a need for a particular connecting bush which must be inserted both into the open end of the luminaire mast and into the plug-in base in order to bring about the connection. This means a greater outlay on labor.

In a construction known from U.S. Pat. No. 4,639,843, the side-mounting end of the luminaire mast is provided with a bush which closes this side-mounting end. For its part, the side-mounting luminaire likewise has at the mounting part a bush which closes the tube thereof. The two bushes are screwed together by means of a central, axially guided screw serving as securing element. The outside diameter of the luminaire mast and of the mast top unit luminaire are equal in the transition region. The connection is highly specific and requires a specific luminaire mast.

It is an object of the invention to create a device for connecting the plug-in base of a side-mounting luminaire to a carrier tube, in particular to the tube of a luminaire mast, wherein the securing element effects the mutual clamping with a large clamping force, and plugging together can be performed easily without special provisions.

The object set is achieved according to the invention in that the securing element cooperates with a clamping device which, when the securing element is inserted into the tube interior, converts the clamping force directed away from said element into the tube interior into a clamping force directed outward from the tube interior, the clamping device pressing a clamping member against the inner wall of the carrier tube, which wall serves as the abutment.

The advantage of this device consists in that the clamping force between the side-mounting luminaire and the carrier tube is strengthened as a consequence of the reversal of direction of the force and comes to act more securely.

It is provided in accordance with a further embodiment of the invention that the clamping device comprises a rocker arm which is pivotably mounted in the plug-in base such that the securing element pressing from the outside inward against one rocker arm end swivels the rocker arm and presses the other rocker arm end from the inside outward against the inner wall forming the abutment of the carrier tube. Such a rocker arm has proved to be simple and very effective.

It is provided in a further embodiment of the invention that the securing element to be actuated from the outside inward is a setscrew which is known per se and which is to be provided on the side-mounting luminaire. A setscrew is an advantageous component also for the clamping device.

It is provided in a further embodiment of the invention that the plug-in base of the side-mounting luminaire can be plugged directly into an open end of the carrier tube. The setscrew acting as the securing element can thus be fully screwed into the tube or wall material of the side-mounting luminaire and is thus securely guided in the wall material.

It is provided in a further embodiment of the invention that the portion of the plug-in base inserted into the open end of the carrier tube is provided on its outside with contact ridges which extend in its longitudinal direction and, upon being plugged into the carrier tube, fit closely against the inner wall thereof.

It is provided in a further embodiment of the invention that the outside diameter of a luminaire tube which belongs to the side-mounting luminaire and which the plug-in base adjoins corresponds to the outside diameter of the carrier tube.

The invention will be explained in more detail with reference to an example of an embodiment. In the drawing.

Figure 1:
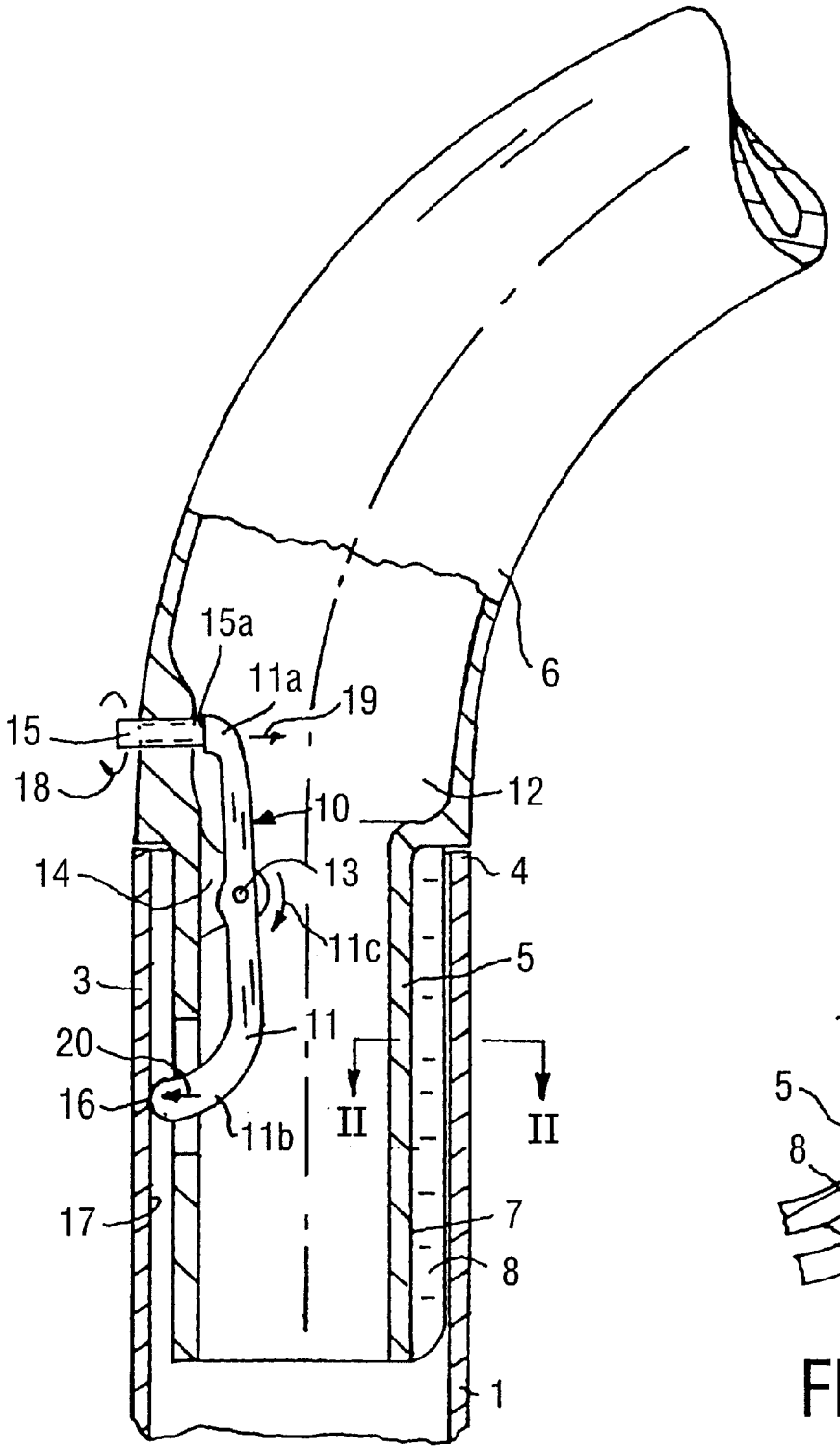
FIG. 1 shows a device for connecting a luminaire mast to a mast top unit luminaire. The connection has a plug-in device and a clamping device for the mutual clamping of the luminaire mast and side-mounting luminaire.
Figure 2:
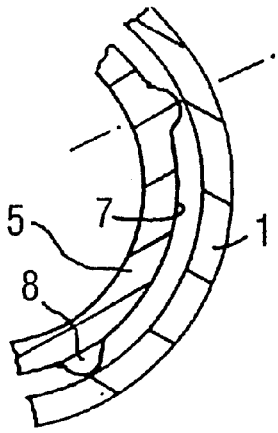
FIG. 2 shows a section II—II through a part of the connection in order to illustrate the contact ridges preventing any play between the luminaire mast and the base of the side-mounting luminaire.

FIG. 1 shows the upper, open end 1 of a luminaire mast 3. It is preferably the carrier tube 3 of a street luminaire, open-space luminaire, sports ground luminaire, railroad luminaire or the like. The plug-in base 5 of a mast side-mounting luminaire is plugged in onto the upper open edge 4. In order to permit insertion, the plug-in base 5 has a diameter that is reduced by comparison with the tube 6 of the side-mounting luminaire. The reduction in diameter is so considerable that the plug-in base 5 per se could be plugged into the carrier tube 3 in an easily moving fashion with a lot of clearance. However, this would run counter to a firm seat. Consequently, as can be seen in FIG. 2, contact ridges 8 running in longitudinal direction are provided on the outer wall 7 of the plug-in base 5. These contact ridges 8 project from the outer wall 7 of the plug-in base 5 so far that, when the plug-in base 5 is plugged into the carrier tube 3, they come completely into contact with the latter. This produces an uninterrupted seating of the side-mounting luminaire in the carrier tube 3.

A clamping device 10 with a rocker arm 11 serves to clamp the side-mounting luminaire in the carrier tube 3. The rocker arm 11 is located in the interior 12 of the plug-in base 5 by means of a rocker bearing 13 which is located on a support 14. The rocker arm 11 has a first rocker arm end 11*a*, which cooperates with a securing element 15, i.e. a setscrew. The other, second rocker arm end 11*b* can be pressed against an abutment 16 which forms part of the inner wall 17.

When the setscrew 15 is screwed in the direction of an arrow 18 into the luminaire tube 6, it is guided inward in the direction of the arrow 18. The inner end 15*a* of the setscrew 15 in this case presses the first rocker arm end 11*a* inward. The rocker arm 11 tilts in the direction of an arrow 11*c*; it reverses the inwardly directed clamping force action proceeding from the setscrew 15. Because of the reversal of direction, the second rocker arm end 11*b* strikes against the inner wall 17 of the carrier tube 3 in a now opposed clamping force direction of an arrow 20.

The side-mounting luminaire is thereby clamped firmly at the support tube 3, specifically on the basis of the laws of the lever, with double the clamping force in comparison with the actuating force applied by the setscrew 15. The side-mounting luminaire is therefore fixed more securely than would be the case with the directly linearly acting setscrew only.

Because of the reduction in diameter of the plug-in base 5, no additional auxiliary components are required to plug the mast side-mounting luminaire on the carrier tube 3, which at the same time is the luminaire mast. The connection is therefore very simple. Again, it is possible without additional measures to create a smooth transition from the tube 6 of the mast side-mounting luminaire to the carrier tube 3 in that the diameters of the carrier tube 3 and of the tube 6 of the mast side-mounting luminaire correspond to one another. This is possible without difficulty.

What is claimed is:

1. A device for connecting the plug-in base (5) of a side-mounting luminaire to a carrier tube (3), in particular to the tube (3) of a luminaire mast, it being possible for the plug-in base (5) of the side-mounting luminaire to be connected to the carrier tube (3) and to be fixed to the carrier tube (3) by means of a securing element (15) that can be inserted into the side-mounting luminaire from the outside inward, and it being possible for the securing element (15) to be pressed against an abutment which effects clamping, characterized in that the securing element (15) cooperates with a clamping device (10) which, when the securing element (15) is inserted into the tube interior (12), converts the clamping force directed away from said element into the tube interior (12) into a clamping force directed outward from the tube interior (12), the clamping device (10) pressing a clamping member (11*b*) against the inner wall (17) of the carrier tube (3), which wall (17) serves as the abutment (15).

2. A device as claimed in claim 1, characterized in that the clamping device (10) comprises a rocker arm (11) which is pivotably mounted in the plug-in base (5) such that the securing element (15) pressing from the outside inward against a first rocker arm end (11*a*) swivels the rocker arm (11) and presses the other rocker arm end (11*b*) from the inside outward against the inner wall (17) forming the abutment (16) of the carrier tube (3).

3. A device as claimed in claim 1, characterized in that the securing element (15) to be actuated from the outside inward is a setscrew which is known per se and which is provided on the side-mounting luminaire.

4. A device as claimed in claim 1, characterized in that the plug-in base (5) of the side-mounting luminaire can be plugged directly into an open end (4) of the carrier tube (3).

5. A device as claimed in claim 1, characterized in that the portion of the plug-in base (5) plugged into the open end (4) of the carrier tube (3) is provided on its outside (7) with contact ridges (8) which extend in its longitudinal direction and, upon being plugged into the carrier tube (3), fit closely against the inner wall (17) thereof.

6. A device as claimed in claim 1, characterized in that the outside diameter of a luminaire tube (6) which belongs to the side-mounting luminaire and which the plug-in base (5) adjoins corresponds to the outside diameter of the carrier tube (3).

* * * * *